US006986593B2

(12) United States Patent
Rhoads et al.

(10) Patent No.: US 6,986,593 B2
(45) Date of Patent: Jan. 17, 2006

(54) METHOD AND APPARATUS FOR LIGHT COLLECTION, DISTRIBUTION AND ZOOM

(75) Inventors: Greg Rhoads, Irvine, CA (US); Ronald Garrison Holder, Laguna Niguel, CA (US)

(73) Assignee: Illumination Management Solutions, Inc., Irvine, CA (US)

( * ) Notice: Subject to any disclaimer, the term of this patent is extended or adjusted under 35 U.S.C. 154(b) by 14 days.

(21) Appl. No.: 10/897,297

(22) Filed: Jul. 21, 2004

(65) Prior Publication Data

US 2005/0073849 A1 Apr. 7, 2005

Related U.S. Application Data

(60) Provisional application No. 60/508,996, filed on Oct. 6, 2003.

(51) Int. Cl.
*F21V 7/00* (2006.01)

(52) U.S. Cl. ..... 362/308; 362/256; 362/309; 362/336; 362/338; 362/346; 362/347; 257/98

(58) Field of Classification Search ..... 362/296–298, 362/341, 346–347, 350, 255–256, 336, 338, 362/308–309; 257/98
See application file for complete search history.

(56) References Cited

U.S. PATENT DOCUMENTS 826,205 A * 7/1906 Whitehouse ..... 362/335
4,101,957 A * 7/1978 Chang ..... 362/268
4,151,584 A * 4/1979 Labrum ..... 362/302
4,388,673 A * 6/1983 Maglica ..... 362/183
4,392,187 A * 7/1983 Bornhorst ..... 362/233
4,500,947 A * 2/1985 Perkins ..... 362/477
4,530,040 A 7/1985 Petterson
4,583,153 A * 4/1986 Tsuyama ..... 362/517
4,698,730 A * 10/1987 Sakai et al. ..... 362/311
4,745,531 A * 5/1988 Leclercq ..... 362/281
4,803,605 A * 2/1989 Schaller et al. ..... 362/184
4,814,950 A * 3/1989 Nakata ..... 362/539
4,941,070 A * 7/1990 Ogawa et al. ..... 362/3
4,959,757 A * 9/1990 Nakata ..... 362/518
4,962,450 A * 10/1990 Reshetin ..... 362/268
5,060,120 A * 10/1991 Kobayashi et al. ..... 362/465
5,072,346 A * 12/1991 Harding ..... 362/187
5,103,381 A * 4/1992 Uke ..... 362/560
5,249,109 A * 9/1993 Denison et al. ..... 362/285
5,268,977 A * 12/1993 Miller ..... 385/33
5,282,121 A * 1/1994 Bornhorst et al. ..... 362/294
5,526,248 A * 6/1996 Endo ..... 362/538

(Continued)

*Primary Examiner*—Stephen Husar
*Assistant Examiner*—Jason Han
(74) *Attorney, Agent, or Firm*—Daniel L. Dawes; Myers Dawes Andras & Sherman LLP

(57) ABSTRACT

An LED or incandescent light source is positioned in a reflector arranged to reflect light from the LED or incandescent light source which is radiated from the LED or incandescent light source in a peripheral forward solid angle as defined by the reflector. A lens is disposed longitudinally forward of the LED or incandescent light source for focusing light into a predetermined pattern which is radiated from the LED or incandescent light source in a central forward solid angle as defined by the lens. The apparatus comprised of the combination projects a beam of light comprised of the light radiated in the central forward solid angle and peripheral forward solid angles.

55 Claims, 4 Drawing Sheets

U.S. PATENT DOCUMENTS 5,577,493 A * 11/1996 Parkyn et al. ..... 126/699
5,630,661 A * 5/1997 Fox ..... 362/187
5,673,990 A * 10/1997 Neumann et al. ..... 362/513
5,711,590 A * 1/1998 Gotoh et al. ..... 362/43
5,808,775 A * 9/1998 Inagaki et al. ..... 359/212
5,897,196 A * 4/1999 Soskind et al. ..... 362/507
5,899,559 A * 5/1999 Lachmayer et al. ..... 362/513
5,904,417 A * 5/1999 Hewett ..... 362/321
5,934,795 A * 8/1999 Rykowski et al. ..... 362/309
5,954,428 A * 9/1999 Eichhorn et al. ..... 362/543
5,986,779 A * 11/1999 Tanaka et al. ..... 359/19
6,007,210 A * 12/1999 Yamamoto et al. ..... 362/459
6,123,440 A * 9/2000 Albou ..... 362/516
6,220,736 B1 * 4/2001 Dobler et al. ..... 362/539
6,227,685 B1 * 5/2001 McDermott ..... 362/318
6,252,338 B1 * 6/2001 Bergman et al. ..... 313/113
6,280,071 B1 * 8/2001 Yamamoto et al. ..... 362/539
6,354,721 B1 * 3/2002 Zattoni ..... 362/513
6,406,171 B1 * 6/2002 Satsukawa et al. ..... 362/518
6,536,899 B1 * 3/2003 Fiala ..... 351/168
6,547,423 B2 * 4/2003 Marshall et al. ..... 362/333
6,575,609 B2 * 6/2003 Taniuchi et al. ..... 362/517
6,575,610 B2 * 6/2003 Natsume ..... 362/520
6,603,243 B2 * 8/2003 Parkyn et al. ..... 313/113
6,741,406 B2 * 5/2004 Kitamura et al. ..... 359/819
6,796,690 B2 * 9/2004 Bohlander ..... 362/471
6,827,467 B2 * 12/2004 Tenmyo ..... 362/268
2002/0145884 A1 * 10/2002 Yamamoto ..... 362/548
2003/0007359 A1 * 1/2003 Sugawara et al. ..... 362/326
2003/0090906 A1 * 5/2003 Hayakawa ..... 362/517
2004/0017685 A1 * 1/2004 Dedoro ..... 362/268

* cited by examiner

METHOD AND APPARATUS FOR LIGHT COLLECTION, DISTRIBUTION AND ZOOM

RELATED APPLICATIONS

The present application is related to U.S. Provisional Patent Application Ser. No. 60/508,996, filed on Oct. 6, 2003, which is incorporated herein by reference and to which priority is claimed pursuant to 35 USC 119.

BACKGROUND OF THE INVENTION

1. Field of the Invention

The invention relates the field of light sources using light emitting diodes (LEDs) and in particular to an apparatus and a method of collecting the energy radiating from them. The device could be used in general lighting, decorative and architectural lighting, portable and nonportable lighting, emergency lighting, fiber optic illumination and many other applications.

2. Description of the Prior Art

Typically in the prior art LED light source either a lens or a reflector is used to collect most of the $2\pi$ steradians front solid angle or forward hemispherical wavefront of light radiating from an LED. Recall that the solid angle $\Omega$ subtended by a surface S is defined as the surface area $\Omega$ of a unit sphere covered by the surface's projection onto the sphere. This can be written as:

$$\Omega \equiv \int\int_S \frac{\hat{n}\cdot d\vec{a}}{r^2}, \tag{1}$$

where $\hat{n}$ is a unit vector from the origin, da is the differential area of a surface patch, and r is the distance from the origin to the patch. Written in spherical coordinates with $\phi$ the colatitude (polar angle) and $\theta$ for the longitude (azimuth), this becomes $$\Omega \equiv \int\int_S \sin\phi d\theta d\phi. \tag{2}$$

A solid angle is measured in steradians, and the solid angle corresponding to all of space being subtended is $4\pi$ steradians.

Total internal reflection (TIR) is also used where the energy from the LED is collected both by an internal shaped reflector-like surface of a first lens and a second lens formed on either the outside or inside surface of the first lens.

Typically devices using a reflector alone generate a beam with two parts, one portion of the beam is reflected and controlled by the reflector and the other portion of the beam is direct radiation from the LED and is not controlled, i.e. not reflected or refracted by any other element. On a surface onto which this two-part beam is directed, the direct light appears as a large halo around the reflected beam. In the conventional 3 or 5 mm LED package a ball lens is situated in front of a cylindrical rod, and the side emitted energy from the LED is substantially uncontrolled or radiated substantially as it is generated out of the emitter junction in the chip. In TIR systems, some portion of the energy radiated from the LED junction is leaked through the walls of the package and remains uncontrolled. Additionally, there are bulk and form losses as well. In systems with LEDs turned around to point back into a concave reflector, the center energy from the LED is shadowed by the LED package itself, so this energy is typically lost or not collected into a useful beam.

What is needed is some type of design whereby efficient collection of almost all of an LED's radiated energy can be obtained and projected into a directed beam with an illumination distribution needed to be useful.

BRIEF SUMMARY OF THE INVENTION

The invention is defined as an apparatus comprising an LED light source, a reflector positioned to reflect light from the LED light source which is radiated from the LED light source in a peripheral forward solid angle as defined by the reflector, and a lens disposed longitudinally forward of the LED light source for focusing light into a predetermined pattern which is radiated from the LED light source in a central forward solid angle as defined by the lens, so that the apparatus projects a beam of light comprised of the light radiated in the central forward solid angle and peripheral forward solid angles. Whereas the light source is described in the illustrated embodiment as an LED, it must be expressly understood that an incandescent or other light source can be substituted with full equivalency. Hence, wherever in the specification, "light source" is used, it must be understood to include an LED, incandescent, arc, fluorescent or plasma arc light or any equivalent light source now known or later devised, whether in the visible spectrum or not. Further, the light source may collectively comprise a plurality of such LEDs, incandescent, arc, fluorescent or plasma light sources or any other light sources now known or later devised organized in an array.

The central forward solid angle and the peripheral forward solid angle are demarcated from each other at approximately 0.6 $\pi$ steradian solid angle centered on the optical axis of the light source. The light source comprises an LED emitter and a package in which the LED emitter is disposed. The package comprises a hemispherical front protective dome for minimizing refraction of light radiated from the LED emitter by the package. The lens is disposed longitudinally forward of the dome.

In one embodiment the lens is suspended in front of the package lens by means of a spider.

The lens approximately collimates light radiated by the LED source into the central forward solid angle and the reflector approximately collimates light radiated by the LED source into the peripheral forward solid angle. In one embodiment of the invention the two separately formed beams will appear as if they were one. The designer has control over the individual beams, however, and may tailor the beam output individually or together to generate the desired result. In another preferred embodiment the beam or beams would be variable and the adjustment of one or both would provide a desired beam effect such as zoom or magnification.

In another embodiment the lens is disposed on the dome or made integrally with it. The lens is comprised of a peripheral annular portion having a first radius, $r_1$, of curvature and a central portion having a second radius of curvature, $r_2$, in which $r_1>r_2$. The peripheral annular portion minimally refracts light radiated from the LED light source, if at all, and where the central portion refracts light radiated from the LED light source to form a predetermined pattern of light.

The reflector has a focus and where the focus of the reflector is centered on the LED light source.

In the illustrated embodiment the lens is arranged and configured relative to the LED light source so that the central forward solid angle extends to a solid angle of approximately 0.6 π steradians centered on the optical axis. The reflector is arranged and configured relative to the LED light source so that the peripheral forward solid angle extends from a solid angle of approximately 0.6 π steradians to a solid angle of approximately 2 π steradians centered on the optical axis for an included solid angle of about 1.4 π steradians. More specifically, the reflector is arranged and configured relative to the LED light source so that the peripheral forward solid angle extends from a solid angle of approximately 0.6 π steradians centered on the optical axis to a solid angle of approximately 2π steradians centered on the optical axis.

In one implemented embodiment the lens is arranged and configured relative to the LED light source so that the central forward solid angle extends to a solid angle of more than 0.6π steradians centered on the optical axis, and the reflector is arranged and configured relative to the LED light source so that the peripheral forward solid angle extends from central forward solid angle to a solid angle of more than 2π steradians centered on the optical axis.

The invention is also defined as a method comprising the steps of radiating light from an LED light source, reflecting light into a first predetermined beam portion, which light is radiated from the LED light source in a peripheral forward solid angle, and focusing light into a second predetermined beam portion, which light is radiated from the LED light source in a central forward solid angle. The central forward solid angle and the peripheral forward solid angle are demarcated from each other at approximately 0.6 π steradian solid angle centered on the optical axis. Where the light source comprises an LED emitter and a package in which the LED emitter is disposed, the method further comprises the step of minimizing refraction of light radiated from the LED emitter through the package in the peripheral forward solid angle. Focusing the light into the second predetermined beam portion comprises approximately collimating the light radiated by the LED source into the central forward solid angle. Reflecting light into a first predetermined beam portion comprises approximately collimating light radiated by the LED source into the peripheral forward solid angle.

In the embodiment where the lens is disposed on the LED package, the step of focusing light into a second predetermined beam portion comprises disposing a lens on the protective dome of the LED light source, transmitting the light radiated from the LED light source through a peripheral annular portion of the lens having a first radius, $r_1$, of curvature into the peripheral forward solid angle, and transmitting the light radiated from the LED light source through a central portion of the lens having a second radius of curvature, $r_2$, into the central forward solid angle in which $r_1>r_2$. Transmitting the light radiated from the LED light source through a peripheral annular portion of the lens minimally refracts light radiated from the LED light source, if at all. Transmitting the light radiated from the LED light source through a central portion of the lens refracts light radiated from the LED light source to form a predetermined pattern of light.

The step of reflecting light into a first predetermined beam portion comprises centering the focus of the reflector on the LED light source. The step of focusing light into a second predetermined beam portion comprises generating the central forward solid angle to extend to a solid angle of approximately 0.6 π steradians centered on the optical axis of the light source. The step of reflecting light into a first predetermined beam portion comprises generating reflected light into the peripheral forward solid angle extending to a solid angle of approximately 2π steradians centered on the optical axis, or more specifically reflecting the light from the LED light source into the peripheral forward solid angle extending from a solid angle of approximately 0.6 π steradians centered on the optical axis to a solid angle of approximately 2π steradians centered on the optical axis.

In one embodiment, the step of focusing light into a second predetermined beam portion comprises generating a focused beam portion into the central forward solid angle extending to a solid angle of more than 0.6 π steradians centered on the optical axis, and reflecting light into a first predetermined beam portion comprises generating a reflected beam portion into the peripheral forward solid angle extending from central forward solid angle to a solid angle of more than 2π steradians centered on the optical axis.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 2:
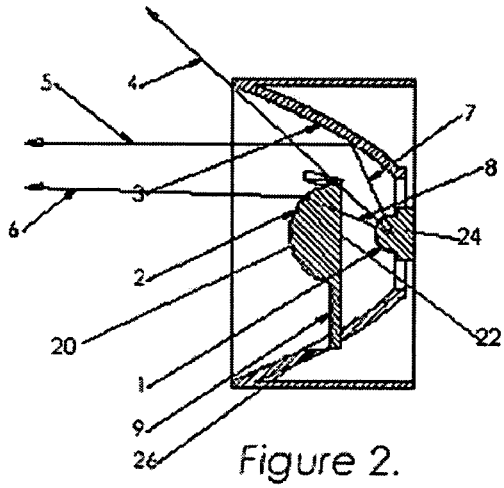
FIG. 2 is a side cross-sectional view of the embodiment of FIG. 1.
Figure 1:
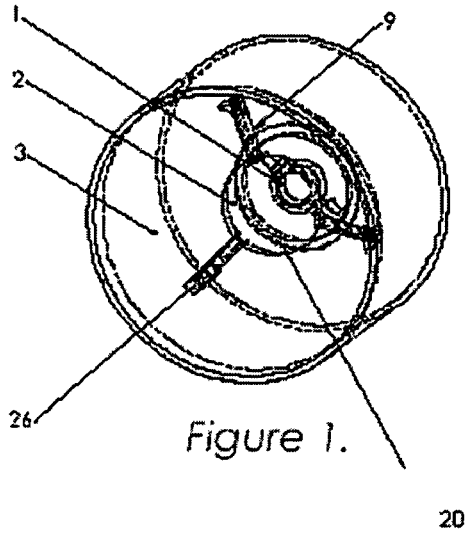
FIG. 1 is a perspective view of a first embodiment of the LED device of the invention.

In FIGS. 1–4 a device incorporating the invention is generally denoted by reference numeral 24. LED source 1 is shown as packaged in a conventional package, which is comprised of a substrate in which the light emitting junction is defined encapsulated in a transparent epoxy or plastic housing formed to provide a front hemispherical front dome over the light emitting junction or chip. Many different types and shapes of packages could be employed by an LED manufacturer and all types and shapes are included within the scope of the invention. Hereinafter in the specification the term, "LED source 1" and in another embodiment as "LED source 18", shall be understood to include the passivating package in which the light emitting junction or chip is housed. FIG. 1 shows a preferred embodiment of the invention in which a lens 2 is suspended over an LED source 1 by arms 9 which are attached to notches 26 in the reflector 3. It must be expressly understood that lens 2 is meant to also include a plurality of lenses, such as a compound lens or an optical assembly of lenses. The surface of reflector 3 may be specially treated or prepared to provide a highly specular or reflective surface for the wavelengths of light emitted by LED source 1. In the illustrated embodiment lens 2 is shown in FIGS. 1–4 as having a hemispherical front surface 20 and in the embodiment of FIGS. 1 and 2 a rear planar surface 22 or in the embodiment of FIGS. 3 and 4 a rear curved surface 23. Again, it is to be expressly understood that lens 2 need not be restricted to one having a hemispherical front surface 20, but may be replaced with a combination of multiple lenses of various configurations. Reflector 3 may include or be connected to an exterior housing 28, which provides support and connection to the apparatus (not shown) in which device 24 may be mounted. LED source 1 is disposed in the center of reflector 3 by housing 28 or other means (not shown) on the common optical axis of LED source 1, reflector 3 and lens 2. The lens 2 is suspended over the reflector 3 and the LED source 1 by means of spider 9 in such manner as to interfere as little as possible with the light radiating from or to the reflector 3. The embodiment of FIG. 1 and 2 show a three legged spider 9, however, many other means may employ as fully equivalent.

In FIG. 2, the LED source 1 is positioned substantially at the focus of a concave reflector 3 in such a manner as to collect essentially all the energy from the LED source 1 that is radiating into a region between about the forward 0.6 $\pi$ steradian solid angle centered on the centerline or optical axis of the LED source 1 (45 degrees half angle in side cross-sectional view) and about 2.2 $\pi$ steradian solid angle centered on the centerline or optical axis (95 degrees half angle in side cross-sectional view) for an included solid angle of about 1.6 $\pi$ steradians. The energy in this region, represented by ray 7 in the ray tracing diagram of FIG. 2, is reflected as illustrated by ray 5. The light directly radiating from the LED source 1 that is illustrated by a ray 4 at approximately 45 degrees off the centerline or optical axis will either be reflected by the reflector 3 or collected by lens 2, but will not continue outward as described by the line in FIG. 2 tracing ray 4.

The rays of light radiating from the LED source 1 that are contained within the half angles of about 45 degrees and 0 degrees as illustrated by ray 8 will be collected by the lens 2 and controlled by the optical properties of lens 2 as illustrated in FIG. 2 by ray 6. The arms 9 may be as shown in FIGS. 1 and 2 or provided in many other configurations to suspend the lens 2 over the LED source 1. The only constraint on arms 9 is to support lens 2 in position on the optical axis at the desired longitudinal position consistent with the teachings of the invention while providing a minimum interference with the light propagation. Any configuration of arms 9 consistent with this object is contemplated as being within the contemplation of the invention.

Figure 7:
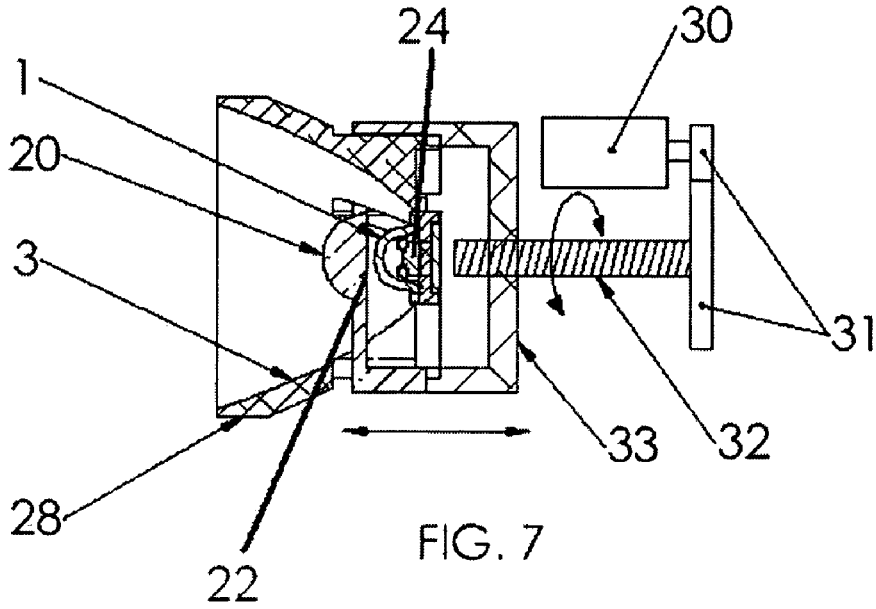
FIG. 7 is a side cross-sectional view of an embodiment of FIGS. 5 and 6 showing a motor and gear train for remote control or automatic zoom control.
Figure 8:
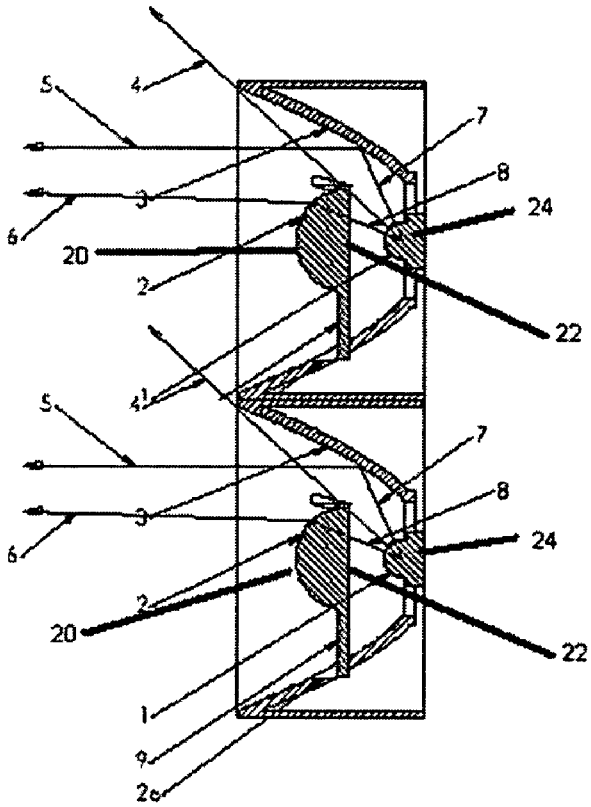
FIG. 8 is a simplified side cross-sectional view of an array of light sources as shown in FIG. 2.

It can thus be understood that the invention is adapted to a zoom or variable focus of the beam. For example, in the embodiment of FIG. 2, as better depicted in FIG. 7, a motorized means 30, 31 is coupled to spider 9 and hence to lens 2 to move lens 2 longitudinally along the optical axis of reflector 3 to zoom or modify the divergence or convergence of the beam produced. FIG. 7 shows a motor 30 coupled to a gear train 31 to provide the motive force for zoom control. Means 30, 31 may assume any type of motive mechanism now known or later devised, and may, for example, comprise a plurality of inclined cams or ramps on a rotatable ring (not shown), which cams urge a spring loaded spider 9 forward along the longitudinal axis when rotated in one sense, and allow spring loaded spider 9 to be pulled back by a spring (not shown) along the longitudinal axis when the ring is rotated in the opposite sense. The ring can be manually rotated or preferably by an electric motor or solenoid, which is controlled by a switch (not shown) mounted on the body, permitting one-handed manipulation of the zoom focus with the same hand holding the body. Manual or motorized zoom subject to manual control is illustrated, but it is also included within the scope of the invention that an optical or radiofrequency circuit may be coupled to motor 30 to provide for remote control.

The variability of zoom focus can be realized in the invention by relative movement of lens 2, reflector 3 and/or LED source 1 in any combination. Hence, the lens 2 and reflector 3 as a unit can be longitudinally displaced with respect to a fixed LED source 1 or vice versa, namely lens 2 and reflector 3 are fixed as a unit and LED source 1 is moved. Similarly, lens 2 can be longitudinally displaced with respect to fixed LED source 1 and reflector 3 as a unit as described above or vice versa, namely lens 2 is fixed as LED source 1 and reflector 3 are moved as a unit. Still further, it is within the scope of the invention that the movement of lens 2, reflector 3 and LED source 1 can each be made incrementally and independently from the other. The means for permitting such relative movements of these elements and for providing motive power for making the movement within the context of the invention is obtained by the application of conventional design principles.

Figure 5:
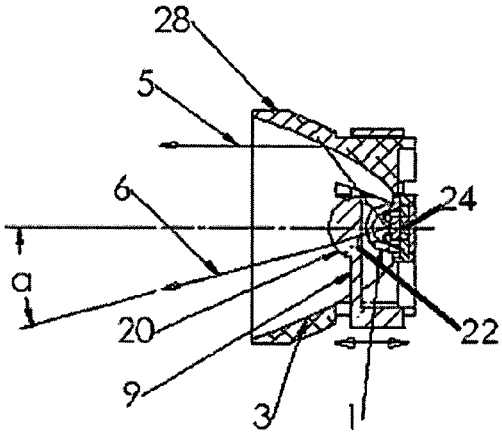
FIG. 5 is a side cross-sectional view of an embodiment of the invention where zoom control by relative movement of various elements in the device is provided and a wide angle beam is formed.
Figure 6:
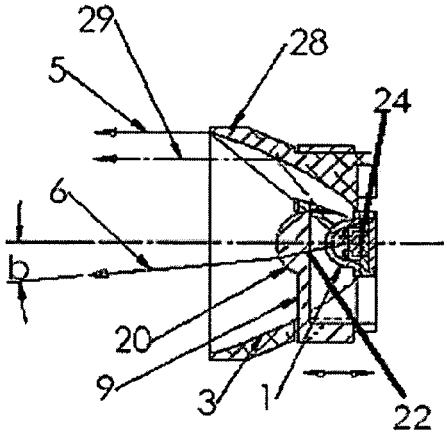
FIG. 6 is a side cross-sectional view of the embodiment of FIG. 5 where a narrow angle beam is formed.

In FIG. 5 ray 5 is defined as that ray which is reflected from reflector 3 and just misses lens 2. In the wide angle beam in FIG. 5 ray 5 is shown in a first position which is assumed by ray 29 in the narrow beam configuration of FIG. 6. In FIG. 6, ray 5 moves radially outward. Hence, energy is taken from the reflected collimated narrow portion of the beam in FIG. 6 and put into the diverging refracted portion of the beam in the wide beam configuration of FIG. 5. By this means the intensity of the wide angle beam is kept more uniform than would otherwise be the case, if energy shifting did not occur during the zoom transition from narrow to wide beam configurations between FIGS. 6 and 5 respectively.

Figure 3:
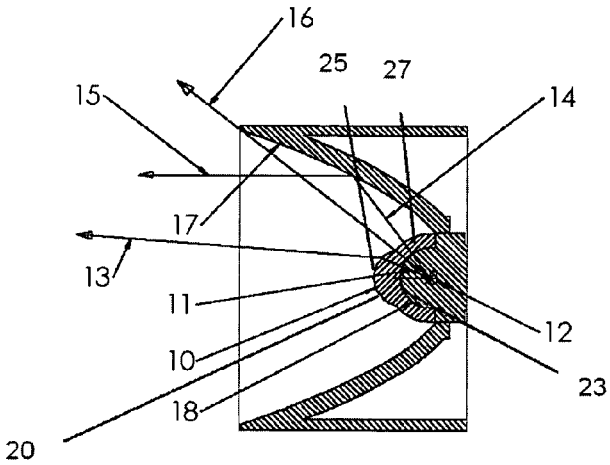
FIG. 3 is a side cross-sectional view of a second embodiment of the invention.
Figure 4:
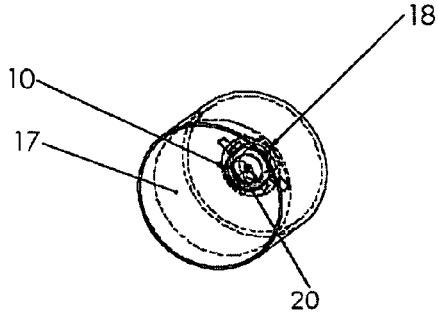
FIG. 4 is a perspective view of a second embodiment of FIG. 3.

FIG. 4 is a perspective view of an additional embodiment of the invention. The LED source 18 and contact lens assembly 10 are positioned within a concave reflector 17 best shown in the side cross-sectional view of FIG. 3. In the embodiment of FIG. 3 contact lens assembly 10 is a separate component from LED source 18 itself. In the embodiment of FIG. 3 contact lens assembly 10 is shown as having a rear surface 23 which conforms to the front surface of the packaging of LED source 18. The front surface of contact lens assembly 10 has a compound curvature formed from two portions 25 and 27, namely a spherical peripheral or azimuthal ring which is a protective surface 27 having a first radius of curvature, $r_1$, centered of approximately on emitter 12 and a central hemispherical surface lens portion 25 extending from surface 27 with a surface of a second smaller radius of curvature $r_2$, where $r_2<r_1$. The contact lens assembly 10 could be incorporated into the packaging of LED source 18.

Essentially all the radiated light energy which is not absorbed by the LED chip from the LED emitter 12 are represented by rays 11, 16 or 14 in the ray diagram of FIG. 3. The light energy radiating from the LED emitter 12 that is represented by ray 16 is shown to be approximately 45 degrees off the central or optical axis of the LED source 18, i.e. within the front 0.6 π steradian solid angle. Ray 14 represents rays that radiate outside the front 0.6 π steradian solid angle, which front solid angle is demarcated by ray 16, and which ray 14 is included in those radiating from approximately 45° half angle to more than 90 degrees half angle off the central or optical axis, namely to outside the front 2π steradian solid angle. The portion of contact lens assembly 10 through which ray 14 passes is essentially spherical about the LED emitter 12 so that it does not affect or refract the direction of ray 14 to any significant extent. Ray 15 represents the rays that are reflected from the reflector 17. Ray 11 represents the rays that lie in the solid cone centered on an LED emitter 12 from the central optical axis of the LED source 18 to ray 16, i.e. the front 0.6 π steradian solid angle. Ray 13 represents the rays that are refracted by surface 25 of lens 10. The lens portion 25 of contact lens assembly 10 through which ray 13 passes refracts or alters the direction of ray 13. Ray 16 as shown in FIG. 3 and ray 4 as shown in FIG. 2 is shown as directly radiated from source 1 or 18 respectively, but in fact the geometry is selected such that rays 4 and 16 either are reflected as rays 5 and 15 respectively, or are refracted as rays 6 and 13 respectively.

The invention provides almost complete or 100% collection efficiency of the light energy radiated from an LED source 1 or 18 for purposes of illumination, and distribution of the collected energy into a controlled and definable beam pattern. Be reminded that an LED is a light emitting region mounted on the surface of a chip or substrate. Light from the radiating junction is primarily forward directed out of the surface of the chip with a very small amount directed to the sides and slightly below the substrate's horizon. Light radiating from the junction into the substrate is partially reflected, refracted and absorbed as heat. The invention collects substantially all the light, or energy radiated from an LED source 1 or 18 which is not absorbed in the substrate on or in which it sits and redirects it into two distinct beams of light as described below. By design, these beams could be aimed primarily into a single direction, but need not be where in an application a different distribution of the beams is desired.

The invention collects all of the LED energy in the two regions or beams. The first region is approximately the forward 0.6π steradian solid angle (45 degree half angle in a side cross-sectional view) and the second region is the energy that is radiated from the LED source 1 or 18 approximately between, for example, the forward 0.6 π steradian and 2.2 π steradian solid angles (47 degree half angle and 95 degree half angle in a side cross-sectional view respectively) for an included solid angle of about 1.6 π steradians. The exact angular dividing line between the two beams can be varied according to the application at hand. The invention thus controls substantially all of the energy radiating from the LED source 1 or 18 with only surface, small figure losses and a small loss due to the suspension means 9 for lens 2. Figure losses include light loss due to imperfections in some aspect of the optical system arising from the fact that seams, edges, fillets and other mechanical disruptions in the light paths are not perfectly defined with mathematical sharpness, but are made from three-dimensional material objects having microscopic roughness or physical tolerances of the order of a wavelength or greater. Losses due to the edges of the Fresnel lens not being infinitely sharp or at least having a lack of sharpness at least in part at a scale of more than a wavelength of light is an example of such figure losses.

In the embodiment of FIGS. 1 and 2 for example, the energy in the first region is collected via lens 2 that is suspended over the LED 1. The energy in the second region is collected via a reflector 3. The slight overlap in collection angle is to insure no energy from the emitter is leaked between the two regions due to the LED emitter being larger than a point source. The resultant beam can be designed to match system requirements by altering either or both of the primary elements, the lens 2 or the reflector 3. The invention allows for either of these surfaces 20 and 22 to be modified to control the resultant beam.

Figure 9:
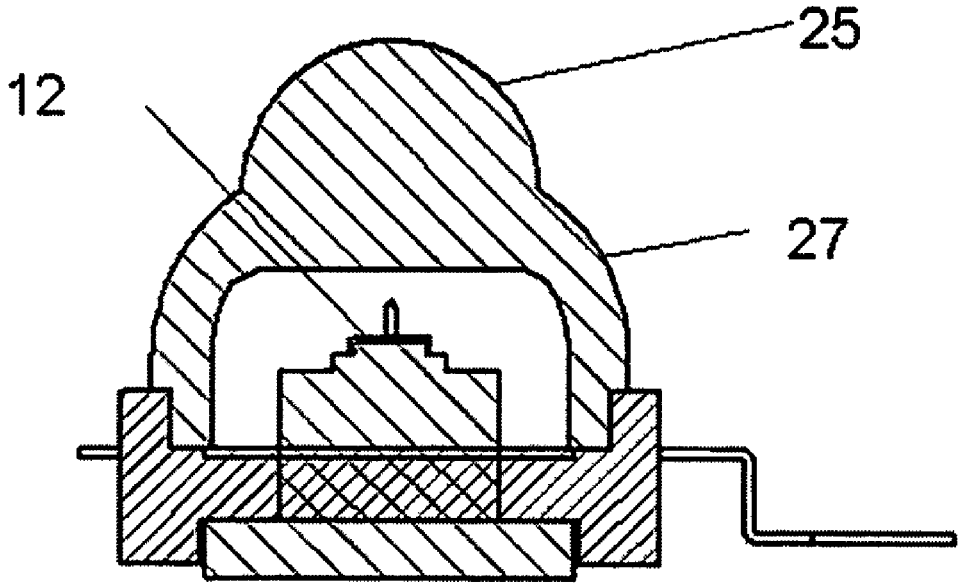
FIG. 9 is a simplified side cross-sectional view of an OEM package lens according to the invention.

The reflector 3 may be designed to provide a collimated, convergent or divergent beam. The reflector 3 may be a common conic or not and may be faceted, dimpled or otherwise modified to provide a desired beam pattern. The device 24 may optionally have at least one additional lens and/or surface(s) formed as part of the LED packaging as illustrated in FIG. 9.

Thus, it can now be understood that the optical design of lens 2 and contact lens assembly 10 including its longitudinal positioning relative to emitter 12 can be changed according to the teachings of the invention to obtain the objectives of the invention. For example, the nature of the illumination in the central solid angle of the two-part beam can be manipulated by the optical design of lens 2 and contact lens assembly 10, e.g. the degree of collimation. Further, the dividing line and transition between the two parts of the beam, namely the central and peripheral solid angles of the beam, can be manipulated by the longitudinal positioning and radial size or extent of lens 2 and contact lens assembly 10 relative to emitter 12.

Multiple numbers of devices 24 may be arrayed to provide additional functionality. These arrays could include two or more instances of the invention that may be individually optimized by having a unique set of lenses 2 and reflectors 3. For example, an array of devices described above could be used to provide more light than a single cell or unit. The various light sources according to the invention in such an array could be pointed in selected directions, which vary according to design for each element depending on the lighting application at hand. The elements may each have a different focus or beam pattern, or may comprise at least more than one class of elements having a different focus or beam pattern for each class. For example, the invention when used in a street light may be designed in an array to have a broadly spread beam directly under the lamp array, and a closer or more specifically focused spot or ring sending light out to the peripheral edges of the illumination pattern.

Many alterations and modifications may be made by those having ordinary skill in the art without departing from the spirit and scope of the invention. For example, while the illustrated embodiment of the invention has been described in the context of a portable flashlight, it must be understood that the potential range of application is broader and specifically includes, but is not limited to, head torches, bike lights, tactical flashlights, medical head lights, automotive headlights or taillights, motorcycles, aircraft lighting, marine applications both surface and submarine, nonportable lights and any other application where an LED light source might be desired.

Still further the invention when implemented as a flashlight may have a plurality of switching and focusing options or combinations. For example, a tail cap switch may be combined with a focusing or zoom means that is manually manipulated by twisting a flashlight head or other part. The tail cap switch could be realized as a twist on-off switch, a slide switch, a rocker switch, or a push-button switch and combined with an electronic switch for focusing. The nature, form and position of the switch and its activated control may assume any form now known or later devised and be combined with a focusing means which is manual, motorized, automated remote control and may also take any form now known or later devised.

Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. An apparatus comprising:

a light source;

a reflector positioned to reflect light into a first directed beam from the light source which light is radiated from the light source into a peripheral forward solid angle; and a lens disposed longitudinally forward of the light source to direct light into a second directed beam which light is radiated from the light source into a central forward solid angle, where the reflector and lens collect almost all the light radiated by the light source and the first beam comprises all the light reflected from the reflector and the second beam comprises all the light directed by the lens and where the first and second beams include substantially all of the light radiated by the light source.

2. The apparatus of claim 1 where the lens approximately collimates light radiated by the light source into the central forward solid angle.

3. The apparatus of claim 2 where the reflector approximately collimates light radiated by the light source into the peripheral forward solid angle.

4. The apparatus of claim 1 where the light source has an optical axis and where the reflector is arranged and configured relative to the light source so that the peripheral forward solid angle extends to a solid angle of approximately 2 $\pi$ steradians centered on the optical axis.

5. The apparatus of claim 4 where the reflector is arranged and configured relative to the light source so that the peripheral forward solid angle extends from a solid angle of approximately 0.6 $\pi$ steradians centered on the optical axis to a solid angle of approximately $2\pi$ steradians centered on the optical axis.

6. The apparatus of claim 1 where the lens is a primary lens receiving light directly from the light source and where the reflector and light source are generally movable together relative to the lens or where the lens is movable relative to the reflector and light source together to provide zoom focusing.

7. The apparatus of claim 6 further comprising motorized means and where the lens is movable by the motorized means.

8. The apparatus of claim 1 further comprising an array of light sources, reflectors and lenses in combination to each form separate elements of the array.

9. The apparatus of claim 8 where, each element has an optical axis and each element has its optical axis oriented in an individually determined direction.

10. The apparatus of claim 8 where, each element has an individually determined focus.

11. The apparatus of claim 8 where the array, each element has an individually determined beam pattern.

12. The apparatus of claim 1 in further combination with a portable flashlight, head torches, bike lights, tactical flashlights, medical head lights, automotive headlights or taillights, motorcycles, aircraft lighting, marine applications both surface and submarine, nonportable lights or sources using an LED.

13. The apparatus of claim 1 where the reflector approximately collimates light radiated by the light source into the peripheral forward solid angle.

14. The apparatus of claim 1 where the reflector has a focus and where the focus of the reflector is centered on the light source.

15. The apparatus of claim 1 where the light source has an optical axis and the central forward solid angle extends to a solid angle of approximately 0.6 π steradians centered on the optical axis of the light source.

16. The apparatus of claim 1 where the light source has an optical axis and where the lens is arranged and configured relative to the light source so that the central forward solid angle extends to a solid angle of approximately 0.6 π steradians centered on the optical axis and where the reflector is arranged and configured relative to the light source so that the peripheral forward solid angle extends from the central forward solid angle to a solid angle of approximately 2π steradians centered on the optical axis.

17. An apparatus comprising:

a light source where the light source comprises an LED emitter and a package in which the LED emitter is disposed, which LED emitter and package provide a Lambertian illumination pattern, the package having a protective dome;

a reflector positioned to reflect light into a first directed beam from the light source which light is radiated from the light source into a peripheral forward solid angle; and a lens separate from the reflector for directing light into a second directed beam which directed light is radiated from the light source into a central forward solid angle, where the reflector and lens collect almost all the light radiated by the light source and the first beam comprises all the light reflected from the reflector and the second beam comprises all the light directed by the lens, where the first and second beams include substantially all of the light radiated by the light source.

18. The apparatus of claim 17 where lens is disposed longitudinally forward of the protective dome.

19. The apparatus of claim 18 where lens is suspended in front of the protective dome.

20. The apparatus of claim 17 where the lens to direct light into the second beam is disposed on or integrally made with the protective dome.

21. The apparatus of claim 20 where the protective dome is comprised of a peripheral portion providing a protective surface having a first radius, $r_1$, of curvature and the lens has a second radius of curvature, $r_2$, in which $r_1>r_2$.

22. The apparatus of claim 20 where the protective dome is comprised of a peripheral portion providing a protective surface having a first radius, $r_1$, of curvature and the lens has a second radius of curvature $r_2$, in which $r_1>r_2$, where the peripheral annular protective portion does not refract the light radiated from the light source, and where the lens refracts light radiated into the central forward solid angle from the light source to form the second beam of light.

23. An apparatus comprising:

a light source;

a reflector positioned to reflect light into a first directed beam from the light source which is radiated from the light source into a peripheral forward solid angle, and a lens disposed longitudinally forward of the light source for directing light into a second directed beam which directed light is radiated from the light source into a central forward solid angle, where the light source has an optical axis and where the central forward solid angle and the peripheral forward solid angle are demarcated from each other between the reflector and the lens at approximately a 0.6 π steradians solid angle centered on a common optical axis of the reflector and lens.

24. An apparatus comprising:

a light source;

a reflector positioned to reflect light into a first directed beam from the light source which light is radiated from the light source into a peripheral forward solid angle; and a lens disposed longitudinally forward of the light source to direct light into a second directed beam which light is radiated from the light source into a central forward solid angle, where the reflector and lens collect almost all the light radiated by the light source and the first beam comprises all the light reflected from the reflector and the second beam comprises all the light directed by the lens and where the first and second beams include substantially all of the light radiated by the light source, where the reflector and light source and the lens are each independently movable from each other with the reflector and light source generally movable together.

25. An apparatus comprising:

a light source;

a reflector positioned to reflect light into a first directed beam from the light source which is radiated from the light source into a peripheral forward solid angle; and a lens disposed longitudinally forward of the light source for directing light into a second directed beam which directed light is radiated from the light source into a central forward solid angle, where the light source has an optical axis and where the central forward solid angle and the peripheral forward solid angle are demarcated from each other between the reflector and the lens at approximately a 0.6 π steradians solid angle centered on a common optical axis of the reflector and lens, and where the reflector and lens collect almost all the light radiated by the light source and where the first and second directed beams include substantially all of the light radiated by the light source.

26. An apparatus comprising:

a light source where the light source comprises an LED emitter and a package in which the LED emitter is disposed, which LED emitter and package provide a Lambertian illumination pattern, the package comprising a protective dome, a reflector positioned to reflect light into a first directed beam from the light source which is radiated from the light source into a peripheral forward solid angle; and a lens separate from the reflector for directing light into a second directed beam which directed light is radiated from the light source into a central forward solid angle, where the reflector and lens collect almost all the light radiated by the light source and the first beam comprises all the light reflected from the reflector and the second beam comprises all the light directed by the lens, where the first and second directed beams include substantially all of the light radiated by the light source, and where the lens for directing light into the second beam is integrally made with and as part of the protective dome.

27. An apparatus comprising:

a light source where the light source comprises an LED emitter and a package in which the LED emitter is disposed, which LED emitter and package provide a Lambertian illumination pattern, the package comprising a protective dome, a reflector positioned to reflect light into a first directed beam from the light source which is radiated from the light source into a peripheral forward solid angle; and a lens separate from the reflector for directing light into a second directed beam which directed light is radiated from the light source into a central forward solid angle, where the reflector and lens collect almost all the light radiated by the light source and the first beam comprises all the light reflected from the reflector and the second beam comprises all the light directed by the lens, and where the first and second directed beams include substantially all of the light radiated by the source, and where the lens for directing light into the second beam is separate from the protective dome, and is disposed onto the protective dome.

28. An apparatus comprising:

a light source where the light source comprises an LED emitter and a package in which the LED emitter is disposed, which LED emitter and package provide a Lambertian illumination pattern, the package comprising a protective dome;

a reflector positioned to reflect light into a first directed beam from the light source which is radiated from the light source into a peripheral forward solid angle; and a lens for directing light into a second directed beam which directed light is radiated from the light source into a central forward solid angle, where the reflector and lens collect almost all the light radiated by the light source and the first beam comprises all the light reflected from the reflector and the second beam comprises all the light directed by the lens, and where the first and second directed beams include substantially all of the light radiated by the light source, where the lens for directing light into the second beam is separate from the protective dome, and is disposed onto the protective dome or is integral therewith, and where there is an air gap between the protective dome and the reflector.

29. A method comprising:

radiating light from a light source;

reflecting light into a first directed beam by a reflector, which light is radiated from the light source into a peripheral forward solid angle, the reflected light being optically unaffected between the light source and the reflector; and directing light into a second directed beam, which light is radiated from the light source into a central forward solid angle, where reflecting and directing light collects almost all the light radiated by the light source, where reflecting the light into the first beam comprises all the light reflected from a reflector and where directing the light into the second beam comprises all the light directed by a lens, and where the first and second directed beams include substantially all of the light radiated by the light source.

30. The method of claim 29 where refracting light into the second directed beam portion comprises approximately collimating the light radiated by the light source into the central forward solid angle into the second directed beam.

31. The method of claim 30 where reflecting light into a first directed beam portion comprises approximately collimating light radiated by the light source into the peripheral forward solid angle into the first directed beam.

32. The method of claim 29 where the light source has a protective dome, where directing light into a second predetermined beam portion comprises disposing a lens on the protective dome or providing the lens integrally with the protective dome, transmitting the light radiated from the light source through a peripheral annular portion of the protective dome having a first radius, $r_1$ of curvature into the peripheral forward solid angle, and transmitting the light radiated from the light source through a central portion of the protective dome which forms or has been provided with the lens, which central portion has a second radius of curvature, $r_2$ in which $r_2>r_2$.

33. The method of claim 32 where transmitting the light radiated from the light source through a peripheral annular portion of the lens comprises transmitting the light substantially unmodified and where transmitting the light radiated from the light source through a central portion of the lens refracts light radiated from the light source to form a central portion of the second directed beam of light.

34. The method of claim 29 where the light source has an optical axis and where reflecting light into a first directed beam portion comprises radiating light from the light source into the peripheral forward solid angle extending to a solid angle of approximately $2\pi$ steradians centered on the optical axis.

35. The method of claim 34 where radiating light into the peripheral forward solid angle comprises radiating the light from the light source into the peripheral forward solid angle extending from a solid angle of approximately 0.6 $\pi$ steradians centered on the optical axis to a solid angle of approximately $2\pi$ steradians centered on the optical axis.

36. The method of claim 29 further comprising providing a primary lens for receiving light directly from the light source, moving a reflector, and light source together relative to the primary lens along an optical axis or moving the primary lens relative to the reflector and light source together along the optical axis to provide zoom focusing.

37. The method of claim 36 where moving the reflector and light source relative to the lens comprising moving the lens by a motorized means.

38. The method of claim 29 where the light source comprises an LED emitter and a package in which the LED emitter is disposed, further comprising minimizing refraction of light radiated from the LED emitter through the package into the peripheral forward solid angle.

39. The method of claim 38 where directing light into the second beam comprises directing light through a lens which is integrally made with and as part of the package.

40. The method of claim 38 where directing light into the second beam comprises directing light through a lens which is separate from the package, but is disposed onto the package.

41. The method of claim 29 where reflecting light into a first directed beam portion comprises approximately collimating light radiated by the light source into the peripheral forward solid angle into the first directed beam.

42. The method of claim 29 where a reflector is provided and has a focus and where reflecting light into a first directed beam portion comprises centering the focus of the reflector on the light source.

43. The method of claim 29 where the light source has an optical axis and where directing light into a second directed beam portion comprises radiating light from the light source into the central forward solid angle which extends to a solid angle of approximately 0.6 π steradians centered on the optical axis of the light source.

44. The method of claim 29 where the light source has an optical axis and where directing light into a second directed beam portion comprises radiating light into the central forward solid angle extending to a solid angle of approximately 0.6 π steradians centered on the optical axis and where reflecting light into the first directed beam portion comprises radiating light into the peripheral forward solid angle extending from the central forward solid angle to a solid angle of approximately 2π steradians centered on the optical axis.

45. The method of claim 29 where radiating light from a light source comprises orienting an array of separate light sources, each in an individually determined direction, and radiating light from the array.

46. The method of claim 29 where radiating light from a light source comprises focusing an array of separate light sources, each with an individually determined focus, and radiating light from the array.

47. The method of claim 29 where radiating light from a light source comprises forming a collective beam pattern from an array of separate light sources, each with an individually determined beam pattern, and radiating light from the array.

48. The method of claim 29 further comprising radiating, reflecting and directing light within a portable flashlight, head torches bike lights, tactical flashlights, medical head lights, automotive headlights or taillights, motorcycles, aircraft lighting, marine applications both surface and submarine nonportable lights, or sources using an LED.

49. The method of claim 29 further comprising generally moving a reflector, and light source together relative to a primary lens which lens receives light directly from the light source, or moving the lens relative to the reflector and light source together to provide zoom focusing.

50. A method comprising:

radiating light from a light source;

reflecting light into a first directed beam, which light is radiated from the light source into a peripheral forward solid angle; and directing light into a second directed beam, which light is radiated from the light source into a central forward solid angle where reflecting the light into the first beam comprises all the light reflected from a reflector and where directing the light into the second beam comprises all the light directed by a lens, and where the first and second directed beams include substantially all of the light radiated by the light source where the light source has an optical axis and where the light from the light source which is radiated into the central forward solid angle and the peripheral forward solid angle are demarcated from each other at an approximately 0 6 π steradians solid angle centered on the optical axis.

51. A method comprising:

radiating light from a light source;

reflecting light into a first directed beam by a reflector, which light is radiated from the light source into a peripheral forward solid angle, the reflected light being optically unaffected between the light source and the reflector;

directing light into a second directed beam, which light is radiated from the light source into a central forward solid angle, and where reflecting and directing light collects almost all the light radiated by the light source, where reflecting the light into the first beam comprises all the light reflected from a reflector and where directing the light into the second beam comprises all the light directed by a lens, where the first and second directed beams include substantially all of the light radiated by the light source; and moving the reflector and light source to provide zoom focusing by:

(i) collectively moving the reflector and light source and (ii) moving the primary lens independently from each other with the reflector and light source generally moving together.

52. A method comprising:

radiating light from a light source;

reflecting light into a first directed beam, which light is radiated from the light source into a peripheral forward solid angle; and directing light into a second directed beam, which light is radiated from the light source into a central forward solid angle where reflecting and directing the light collects almost all the light radiated by the light source, where reflecting the light into the first beam comprises all the light reflected from a reflector and where directing the light into the second beam comprises all the light directed by a lens, where the first and second directed beams include substantially all of the light radiated by the light source, where the light source has an optical axis and where the light from the light source which is radiated into the central forward solid angle and the peripheral forward solid angle are demarcated from each other at an approximately 0.6 π steradians solid angle centered on the optical axis.

53. An improvement in a flashlight having a body, a power source, a light source electrically connected to the power source, and a reflector for reflecting light from the light source, light source having a radiation pattern substantially only into a forward solid angle, the improvement comprising, a configuration of the reflector to reflect the light into a first directed beam from light radiated by the light source into a peripheral forward solid angle, the first directed beam forming part of a composite beam; and a refractive lens disposed longitudinally forward of the light source for directing light into a second directed beam radiated from the light source into a central forward solid angle as defined by the lens the second directed beam, forming part of the composite beam, so that the composite beam of light is entirely comprised of the light radiated into the central forward solid angle and peripheral forward solid angle from the light source, and where the composite beam includes substantially all of the light radiated by the light source.

54. The improvement of claim 53 where no other optical element is positioned between the lens and the light source and further comprising means for adjusting the positions of the lens relative to the reflector and light source together or moving the reflector and light source together relative to the lens to focus or defocus the composite beam such that the direction of the light, which is always remaining in the first directed beam after shifting energy between the first and second directed beams, is unaffected.

55. The improvement of claim 53 where the light source comprises an array of light sources, each with individually oriented directions, individually adjusted focus, and/or individually shaped beam patterns.

* * * * *

UNITED STATES PATENT AND TRADEMARK OFFICE

CERTIFICATE OF CORRECTION

PATENT NO. : 6,986,593 B2 
APPLICATION NO. : 10/897297
DATED : January 17, 2006
INVENTOR(S) : Greg Rhoads and Ronald Garrison Holder It is certified that error appears in the above-identified patent and that said Letters Patent is hereby corrected as shown below:

In claim 32 at column 14, line 21, delete "$r_2 > r_2$" and insert - - $r_1 > r_2$ - - .

In claim 48 at column 15, line 38, delete "torches bike" and insert - - torches, bike - - .

In claim 48 at column 15, line 41, delete "submarine nonportable" and insert - - submarine, nonportable - -.

In claim 50 at column 15, line 66, delete "0 6" and insert - - 0.6 - -.

Signed and Sealed this

Twenty-ninth Day of August, 2006

JON W. DUDAS
*Director of the United States Patent and Trademark Office*